US005607000A

United States Patent [19]

Cripe et al.

[11] Patent Number: 5,607,000

[45] Date of Patent: Mar. 4, 1997

[54] HAZARDOUS MATERIAL LIQUID DISPENSING SYSTEM AND METHOD

[75] Inventors: Jerry D. Cripe, Tempe; Michael P. Menchio, Mesa; Kevin Rak, Scottsdale, all of Ariz.

[73] Assignee: Motorola, Inc., Schaumburg, Ill.

[21] Appl. No.: 332,228

[22] Filed: Oct. 31, 1994

[51] Int. Cl.[6] ..... B67C 3/00

[52] U.S. Cl. ..... 141/21; 141/2; 141/5; 141/59; 141/65; 141/67; 141/198; 137/205; 137/209

[58] Field of Search ..... 141/18, 21, 44, 141/45, 65, 67, 290, 308, 5, 7, 8, 59, 198, 2; 137/205, 207.5, 209, 210, 211

[56] References Cited

U.S. PATENT DOCUMENTS

| | | | |
|---|---|---|---|
| 1,437,916 | 12/1922 | Shelor | 141/45 |
| 2,180,090 | 11/1939 | Mesinger | 137/211 X |
| 2,854,826 | 10/1958 | Johnston | 141/5 X |
| 3,241,580 | 3/1966 | Lichtenberger et al. | 141/5 |
| 3,416,547 | 12/1968 | Glenn, Jr. et al. | 137/210 X |
| 3,661,191 | 5/1972 | Harley et al. | 141/198 X |
| 4,068,687 | 1/1978 | Long | 141/59 |
| 4,136,693 | 1/1979 | Dyke . | |
| 4,601,409 | 7/1986 | DiRegolo | 141/65 X |
| 4,676,404 | 6/1987 | Yamazaki et al. | 137/209 X |
| 4,859,375 | 8/1989 | Lipisko et al. | 137/209 X |
| 4,949,878 | 8/1990 | Jacobi | 222/382 |
| 5,100,562 | 3/1992 | Proctor | 210/774 |
| 5,156,199 | 10/1992 | Hartsell, Jr. et al. | 141/198 X |
| 5,197,442 | 3/1993 | Blumenstock et al. | 123/520 |
| 5,199,472 | 4/1993 | Rollison | 141/65 |
| 5,277,033 | 1/1994 | Sanford et al. | 62/149 |
| 5,279,338 | 1/1994 | Goossens | 141/198 X |
| 5,330,072 | 7/1994 | Ferri, Jr. et al. | 137/209 X |

*Primary Examiner*—J. Casimer Jacyna
*Attorney, Agent, or Firm*—Aaron B. Bernstein; George C. Chen

[57] ABSTRACT

A non-venting hazardous material liquid dispensing system (25) includes a removable supply vessel (7) coupled to a gas source (1) and a permanent buffer vessel (11). The permanent buffer vessel (11) is additionally coupled through a suction pump (14) to the removable supply vessel (7). The suction pump (14) suctions pressure off the permanent supply vessel (11), transferring the pressure to removable supply vessel (7). The transfer of pressure causes hazardous material liquid (34) to be drawn from the removable supply vessel (7) into permanent buffer vessel (11). The permanent buffer vessel (11) dispenses hazardous material liquid (34) to a process tool.

10 Claims, 3 Drawing Sheets

25
1
2
3
4
5
6
7
8
9
10
11
12
13
14
15
16
17
18
19
20
26
29
30
31
32
33
34
35
36
37
38
45
46

HAZARDOUS MATERIAL LIQUID DISPENSING SYSTEM AND METHOD

BACKGROUND OF THE INVENTION

The present invention relates, in general, to liquid dispensing systems, and more particularly, to non-venting hazardous material liquid dispensing systems.

The semiconductor processing industry, as well as others, constantly faces the challenge of health and environmental requirements relating to handling hazardous materials. For example, the Federal Clean Air Act of 1990 places strict requirements on controlling emissions of volatile organic components (VCOs). Typically, permits must be obtained from county or state authorities as changes occur at manufacturing locations which generate VCOs. Furthermore, solvent thermal decomposition units installed to abate hydrocarbon VOC emissions are costly at approximately $1,000 per cubic-feet-per-minute capacity. In addition to federal and state requirements, manufacturers must be sensitive to local community and neighborhood demands for destruction of odors and fumes from semiconductor manufacturing plants.

Under present federal and state requirements, expensive permitting is required for equipment installation or location movement involving hazardous materials. Costs include not only costs of permitting, but costs for hours of professional engineering needed to specify and quantify systems, and to prepare compliance applications and forms. Costs may further include those associated with months of delays waiting for permits to be issued, such as loss of business.

In the past, gallon supply bottles have been used to fill process tools with hazardous material liquids such as VCO solvent type materials. Unfortunately, the gallon supply bottles give rise to many problems. For example, disposal of the bottles themselves, even after they are empty, requires elaborate environmentally safe methods. Additionally, filling tools with supply bottles open to the atmosphere creates vapors and odors in production areas which can effect yields.

As an alternative to gallon bottles open to the atmosphere, refillable vessels have been used in production process tools as single vessels with quick disconnects in line with the tool liquid supply line. Removal of these vessels require a process tool shutdown which severely lowers productivity of process tool. Furthermore, the conventional use of refillable vessels requires that a vessel be replaced in a system before the vessel goes empty, thereby wasting chemicals. Alternatively, the vessel could be replaced after the vessel is empty. However, gas used to drive the chemicals must first be purged away. Any purging must be vented and requires permitting and environmental abatement by some means. If pumping is used then tools must be shut down as vessels are replaced, and purging sequences must be done again.

Hence, a need exists for a non-venting automated liquid transfer system which can run semiconductor processing tools continuously while vessel supply changeouts occur. Furthermore, a need exists for a non-venting system which does not require environmental air permits, thus alleviating cost and time delays associated with conventional methods.

DETAILED DESCRIPTION OF THE DRAWINGS

As discussed in the background section above, environmental laws have brought about the motivation to replacing gallon bottles open to the atmosphere with refillable dispense vessels. However, the present use of refillable dispense vessels gives rise to many drawbacks. For example, the process system must know when a vessel is empty. Unfortunately, level sensing systems are expensive to place in each vessel and do not work for certain production situations because the level sense interferes with the operation of the liquid dispensing system.

Figure 1:
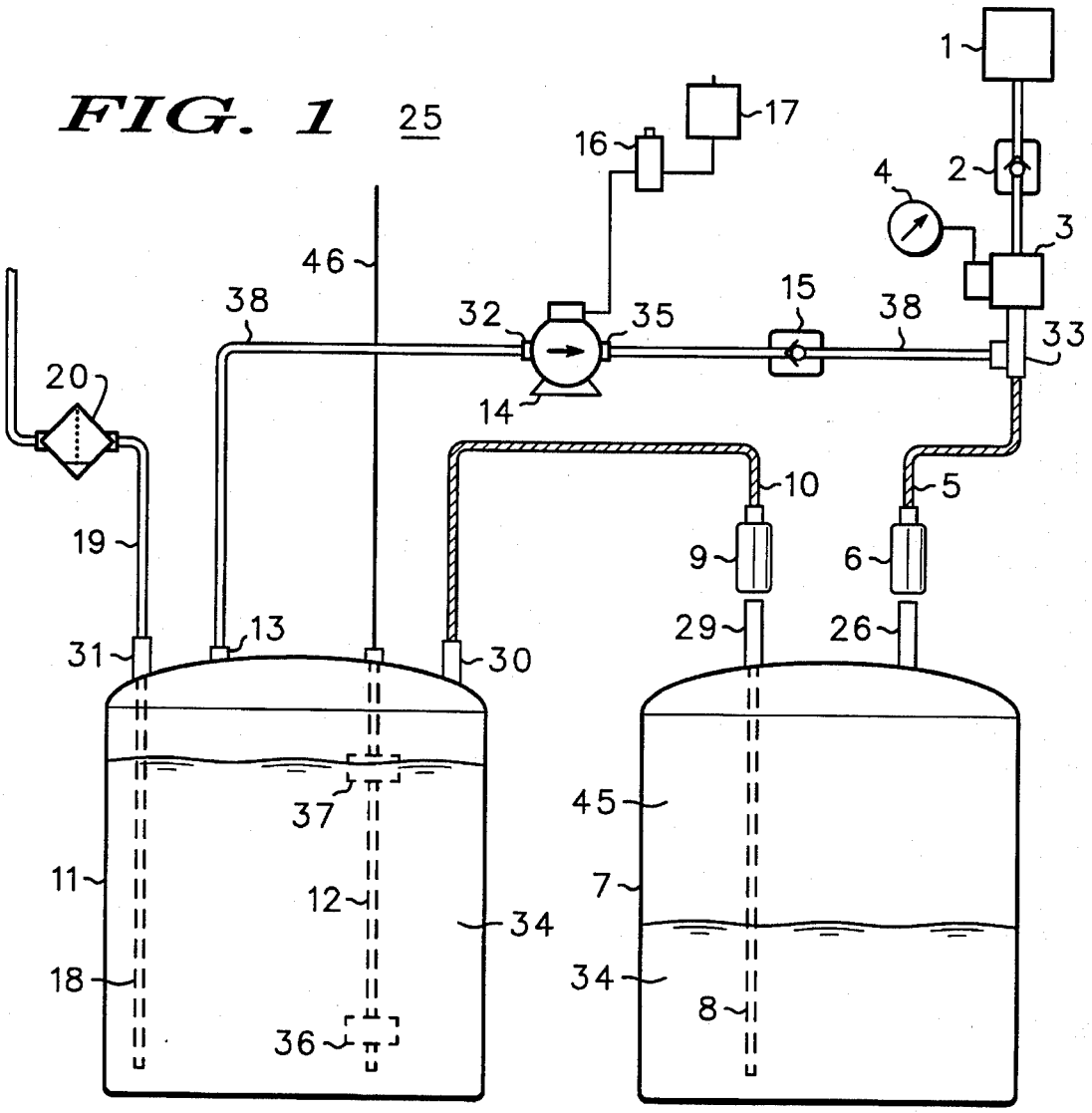
FIG. 1 is a schematic view of a hazardous material liquid dispensing system.

A system and method consistent with the present invention places an additional vessel in series with the liquid dispense vessels for detecting level sense. This vessel also provides a production buffer for vessel changeout, reducing downtime. Furthermore, the system allows 100% use of liquids so vessels can be emptied each time, maximizing savings and lowering costs by increasing throughput. Vessels returned with liquids would require emptying and disposal of hazardous materials, thereby increasing cycle time and cost. The present system incorporates a unique pumping arrangement which resets level sense in the buffer vessel and uniquely allows level reset without venting of vapors over the liquids which would require environmental exhaust air permits and exhaust requirements. Turning to FIG. 1 for an overview of the system, a system 25 for dispensing a hazardous material liquid 34 is shown. The system includes a removable vessel 7. Removable gas vessel 7 has a gas inlet 26 coupled to an output 33 of a regulator 3. An input of the regulator 3 is coupled to an inert gas source 1. Vessel 7 also has a removable vessel liquid output port 29.

The system 25 further includes a permanent vessel 11. The permanent vessel 11 has a permanent vessel liquid input 30 coupled to the removable vessel liquid output 29. The permanent vessel 11 also has a liquid dispensing output port 31, and a gas output port 13 coupled to an input 32 of a transfer pump 14. The transfer pump 14 is inline with a vessel coupling line 38 between the permanent vessel 11 and the removable vessel 7. An output 35 of the transfer pump 14 is coupled to the output 33 of the regulator 3.

Furthermore, a level sense 12 is installed in the permanent vessel 11. The level sense 12 senses the level of the hazardous material liquid 34 in the permanent vessel 11. Specifically, the level sense 12 is capable of detecting when the hazardous material liquid 34 is below a low level 36 and when the hazardous material liquid 34 is above a high level 37.

Figure 2:
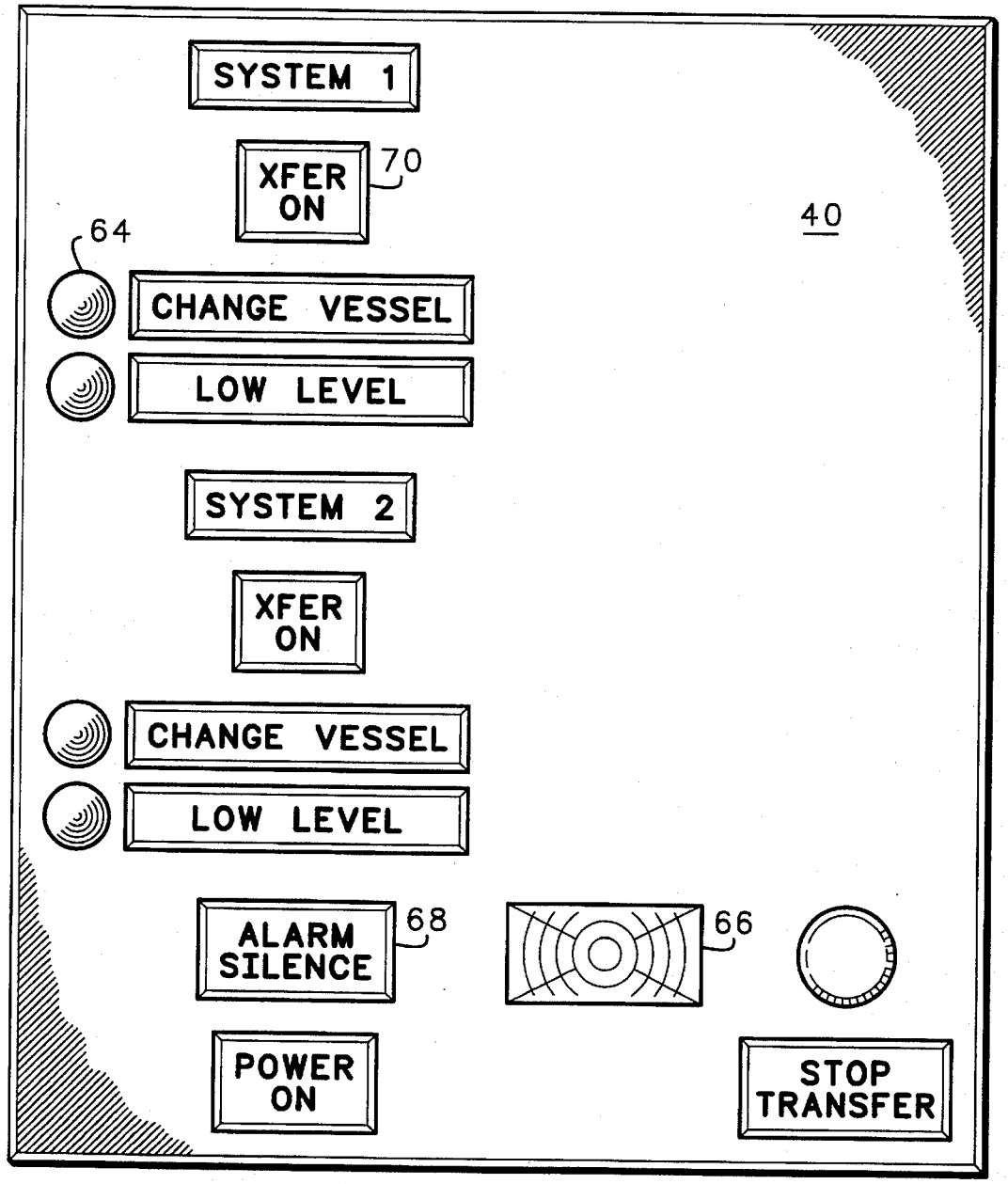
FIG. 2 is a simplified front view of a main control box for the system shown in FIG. 1.

In more detail, the major components of the automated non-venting liquid transfer system 25 include a transportable, easily removable supply vessel 7 and a permanent buffer vessel 11. In the preferred embodiment, the vessels 7, 11 are of the type commonly known as Alloy Products Corp. stainless steel ASME (American Society of Mechanical Engineers) unfired pressure rated vessels with 150 psi rating. The pressure vessels 7, 11 contain a 70 psi pressure release valves (not shown) for safety. Vessels 7, 11 and other components shown in FIG. 1 are preferably placed in a suitable secondary containment cabinet (not shown). Turning briefly to FIG. 2, a main control box 40 is located near the secondary containment cabinet, mounted conveniently for the particular location. In the preferred embodiment, the main control cabinet is approximately 46 cm×30 cm×15 cm and is constructed for compatibility for the environment and liquids in system 25. Specifically, the preferred embodiment uses a box commonly known as a Nema IV™.

Figure 3:
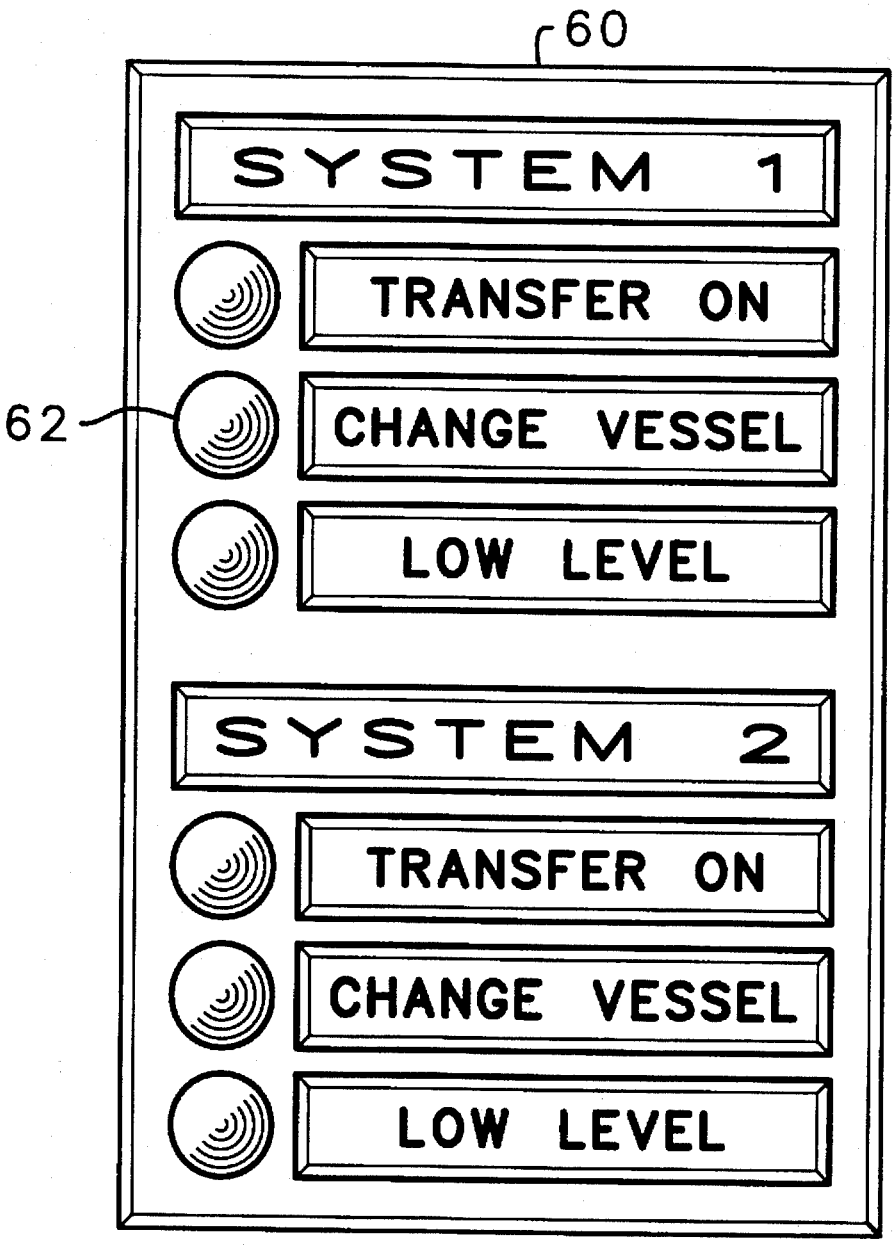
FIG. 3 is a simplified front view of a remote indicator box for the system shown in FIG. 1.

Briefly referring to FIG. 3, remote indicator box 60 is used to enunciate status of the system 25 and is mounted at the point of chemistry usage, such as near the process tool (not shown), providing status information to the operator of the tool. The remote indicator box 60 is approximately 8 cm×13 cm×4 cm, and is constructed of compatible materials for the environment the box is located in. In the preferred embodiment a polyvinyl chloride plastic box with seals is used.

Turning back to FIG. 1, a gas which is inert to the chemistry involved in the liquid transfer is supplied from a gas source 1 to the removable pressure vessel 7. In the preferred embodiment 3–15 psi of nitrogen is used for transfer of either xylene, n-butyl acetate, varnish manufacturer's paint remover (commonly known as VMP a-naptha™), negative resist developer commonly known as Waycoat™, or isopropyl alcohol.

The inert gas is supplied through a check valve 2 into a regulator 3 with a gauge 4 for setting output pressure. Pressure is supplied to the pressure vessel 7 through a stainless steel braided chemistry compatible flexible hose 5 to a quick disconnect 6 at the gas phase or head space 45 of the liquid supply (the space above the liquid level) in the pressure vessel 7. The preferred embodiment uses a double shut off quick disconnect 6 commonly known as a QT series Swagelock™ which is a stainless steel double shut off quick disconnect. The quick disconnect 6 has a spring loaded shut off valve, which stops the flow and leakage of any liquid, sufficient to eliminate any significant risk of fire hazard.

The pressure vessel 7 is the supply vessel which is reused by the chemical supplier to bring in the chemistry (hazardous material liquid 34). The liquid output port 29 of the pressure vessel 7 has a stainless steel dip tube 8 extending to the bottom of the vessel. Dip tube 8 draws off the chemical supply 34. The supply side pressure vessel 7 dispenses liquid 34 through a quick disconnect 9 (preferably the same type as disconnect 6 described above) to the stainless steel braided flex hose 10 which connects to liquid input 30 of the permanent buffer vessel 11.

The pressure vessel quick disconnects 6, 9 are preferably keyed for the inert gas delivery side 26 and liquid output side 29 as follows. All inert gas delivery side quick disconnects 6 are identical and unique. Each liquid output side pressure vessel quick disconnect 9 is also keyed and unique to each specific chemistry type so that different chemicals are not interchangeable by accident.

The permanent buffer vessel 11 has magnetic reed switch level controls 12 for high 37 and low 36 level which give signal outputs via line 46 to a main controller located in or near main control box 40 of FIG. 2. A suction output 13 is hard plumbed through stainless steel tubing and coupling line 38 to the input 32 of pressure transfer pump 14. The pressure transfer pump 14 is preferably a stainless steel housing diaphragm pump commonly available from the manufacturer, Wilden. The wettable diaphragms internally located within pump 14 (not shown) are made of a durable material commonly known as Teflon™, and the pump 14 is air operated from clean dry air through a regulator-filter-lubricator 17 which sets the pressure, filters the air, and adds oil to keep the pump 14 performing well. A solenoid 16 is in line to turn the pressure transfer pump 14 on and off.

The output 35 of the pump 14 is hard plumbed through coupling line 38 (preferably stainless steel tubing), through a check valve 15 and into stainless steel braided line 5 which supplies the pressure supply vessel 7. The liquid dispensing output 31 of the buffer vessel 11 is supplied from a stainless steel dip tube 18 into a hard plumbed output line of stainless steel tubing 19 to a filter 20. Filter 20 is coupled to the point of use at the semiconductor processing tool (not shown). In the preferred embodiment the filter was a Teflon™ cartridge filter rated at 0.2 microns, housed in a stainless steel cartridge housing.

The system in accordance with the present invention operates generally as follows. Referring to FIG. 1, liquid supply vessel 7 containing the hazardous material liquid 34 is coupled to buffer vessel 11 through line 10, and to the inert gas source 1 through line 5. Suction is applied with mechanical pump 14 to the buffer vessel 11 through line 38, transferring pressure from vessel 11 to supply vessel 7 through the pump output 35. This suction and transfer of pressure draws the hazardous material liquid 34 from the liquid supply vessel 7, through line 10, into the buffer vessel 11. Suction is continued until the hazardous material liquid 34 reaches a high level 37 in the buffer vessel 11, the high level being detected by an automatic level sense 12 in the buffer vessel 11.

Suction from pump 14 is discontinued once high level 37 is reached (high level 37 is sensed, and the pump is shut off). The hazardous material liquid 34 dispenses to the process tool (not shown) through output 31 and filter 20, the dispensing causing further drawing of the hazardous material liquid 34 from the liquid supply vessel 7, through line 10. This further drawing of liquid 34 will naturally maintain the level of liquid 34 in buffer vessel 11 at high level 37, due to the equilibrium which is originally set up by the active pumping and suction described above.

In time, all of the hazardous material liquid 34 will be drained from liquid supply vessel 7. Once supply vessel 7 is empty, buffer vessel 11 will nevertheless continue to dispense the hazardous material liquid 34. At this point, the liquid level in buffer vessel 11 will begin to drop. A new supply vessel 7 should then be connected. If the level of buffer vessel 11 reaches level 36, the system will temporarily shut down until a new supply vessel 7 is connected.

In more detail, referring to FIGS. 1, 2 and 3 as necessary, the main control box 40 (located near the system 25) and remote indicator box 60 (located near the tool) each have output lights for two separate dispensing systems 25. The sequence for a cycle of vessels for system one is explained as an example.

The remote indicator status box 60 will light up the change vessel indicator light 62 if the liquid in the buffer vessel 11 is below the high level 37 on the level sense 12. The change vessel light 64 on the main control box 40 will also be turned on and the audible alarm 66 will be making an audible noise until the alarm silence 68 on the main control box 40 is pushed to silence the audible alarm 66. If the audible alarm 66 is silenced, change vessel lights 64 (main control box 40) and 62 (remote box 60) nevertheless remain lit.

If an operator of the system has ignored the system for a length of time such that the process tool has lowered the level in the buffer vessel 11 below the low level 36, then a shut down of the system 25 and the process tool will occur.

Subsequent to either a change vessel light and alarm, or a system shut down, the operator changes out supply vessel 7. The quick disconnects for the supply of inert gas 6 and the output liquid 9 are disconnected. If the liquid level in the buffer vessel 11 is over the low indicator 36, the pressure of inert gas on top of the liquid 34 (inert gas was drawn from vessel 7, once it was empty of liquid 34) will allow the process tool to keep running while supply vessel 7 is being changed out. Consequently, production is not down for a supply vessel 7 change out. The new full supply vessel 7, which is full of the liquid chemistry keyed for the system, is connected by engaging the inert gas disconnect 6 and the output side disconnect 9 to the vessel 7.

Subsequently, the operator pushes the transfer on push switch 70 of main control box 40. This action starts the pressure transfer pump 14. The pump 14 suctions the pressure off the top of the buffer vessel 11 and transfers the pressure to the supply vessel 7. The transfer of pressure allows the supply vessel 7 to transfer the liquid 34 into the buffer vessel 11. The time for the transfer is typically 15 to 60 seconds, in the preferred embodiment.

The transfer of the supply liquid 34 will bring the level of liquid in the buffer supply up to the high level 37 on sense 12, and this will automatically shut off the transfer pump 14, which transferred the gas phase of inert gas off the buffer vessel 11 back into the pressure supply vessel 7. The shut off of the transfer pump 14 allows the check valve 15 to close, preventing inert gas from entering the buffer vessel 11. With the gas phase removed over the buffer vessel 11, the remaining liquid supply 34 in the supply vessel 7 will continue to flow into the buffer vessel 11 as the system 25 runs. The system 25 is now purged of gas over the buffer vessel 11. The system 25 continues to function with no remote indicator lights on until the cycle repeats itself as the process tool uses enough liquid 34 to drop the liquid level in the buffer vessel 11 below the high level 37 on the level sense 12.

While specific embodiments of the present invention have been shown and described, further modifications and improvements will occur to those skilled in the art. It is understood that the invention is not limited to the particular forms shown and it is intended for the appended claims to cover all modifications which do not depart from the spirit and scope of this invention.

We claim:

1. A hazardous material liquid dispensing system dispensing a hazardous material liquid, the system comprising:

a first vessel having a first vessel gas input and a first vessel liquid output;

a second vessel having a second vessel liquid input coupled to the first vessel liquid output, the second vessel further including a liquid output;

a gas source for supplying gas to the system;

a vessel coupling line coupling the second vessel to the first vessel, wherein suction is applied to the second vessel via the vessel coupling line, thereby drawing the hazardous material liquid into the second vessel through the second vessel liquid input;

a regulator having a regulator input and a regulator output, the regulator output coupled to the vessel coupling line; and said gas source coupled to the regulator input.

2. The system of claim 1, further comprising a level sense in the second vessel, the level sense detecting when the hazardous material liquid is below a low level and when the hazardous material liquid is above a high level.

3. The system of claim 1, wherein the vessel coupling line is coupled to the first vessel gas input.

4. The system of claim 3, wherein the gas source is an inert gas source.

5. The system of claim 1, further comprising a pressure transfer pump inline with the vessel coupling line, between the second vessel and the first vessel, the pressure transfer pump having a pump input and a pump output, the pump output coupled to the first vessel gas input and the regulator output.

6. A hazardous material liquid dispensing system dispensing a hazardous material liquid, the system comprising:

a first vessel having a first vessel gas input and a first vessel liquid output;

a second vessel having a second vessel liquid input coupled to the first vessel liquid output, the second vessel further including a liquid output;

a vessel coupling line coupling the second vessel first vessel, wherein suction is applied to the second vessel via the vessel coupling line, thereby drawing the hazardous material liquid into the second vessel through the second vessel liquid input;

a regulator having a regulator input and a regulator output, the regulator output coupled to the vessel coupling line;

a gas source coupled to the regulator input; and a pressure transfer pump inline with the vessel coupling line, between the second vessel and the first vessel, the pressure transfer pump having a pump input and a pump output, the pump output coupled to the first vessel gas input and the regulator output.

7. A hazardous material liquid dispensing system dispensing a hazardous material liquid, the system comprising:

a first vessel having a first vessel gas input and a first vessel liquid output;

a second vessel having a second vessel liquid input coupled to the first vessel liquid output, the second vessel further including a liquid output;

a vessel coupling line coupling the second vessel to the first vessel, wherein suction is applied to the second vessel via the vessel coupling line, thereby drawing the hazardous material liquid into the second vessel through the second vessel liquid input;

a regulator having a regulator input and a regulator output, the regulator output coupled to the vessel coupling line; and a gas source coupled to the regulator input, wherein the vessel coupling line is coupled to the first vessel gas input and wherein the gas source is an inert gas source.

8. An apparatus for dispensing a hazardous material liquid comprising:

a regulator having a regulator input and a regulator output;

a valve coupled to the regulator input;

an inert gas source coupled to the valve;

a transfer pump having a pump output and a pump input, the pump output coupled to the regulator output;

a removable vessel comprising:

a gas inlet coupled to the regulator output and the pump output; and a removable vessel liquid output; and a permanent vessel comprising:

a permanent vessel liquid input coupled to the removable vessel liquid output;

a liquid dispensing output;

a gas output coupled to the pump input; and a level sense to sense different levels of the hazardous material liquid in the permanent vessel.

9. A method for manufacturing a semiconductor component comprising:

providing a first vessel having a first vessel gas input and a first vessel liquid output;

providing a second vessel having a second vessel liquid input coupled to the first vessel liquid output, the second vessel further including a liquid output;

providing a gas source for supplying gas to the system;

providing a vessel coupling line coupling the second vessel to the first vessel;

applying suction to the second vessel via the vessel coupling line, thereby drawing a liquid into the second vessel through the second vessel liquid input;

providing a regulator having a regulator input and a regulator output, the regulator output coupled to the vessel coupling line, said gas source coupled to the regulator input; and using the liquid from the second vessel liquid output to fabricate the semiconductor component.

10. A method for manufacturing a semiconductor component comprising:

providing a regulator having a regulator input and a regulator output;

providing a valve coupled to the regulator input;

providing an inert gas source coupled to the valve;

providing a transfer pump having a pump output and a pump input, the pump output coupled to the regulator output;

providing a removable vessel comprising:

a gas inlet coupled to the regulator output and the pump output; and a removable vessel liquid output;

providing a permanent vessel comprising:

a permanent vessel liquid input coupled to the removable vessel liquid output;

a liquid dispensing output;

a gas output coupled to the pump input; and a level sense to sense different levels of a liquid in the permanent vessel;

extracting the liquid from the liquid dispensing output; and using the liquid from the liquid dispensing output to process the semiconductor component.

* * * * *

UNITED STATES PATENT AND TRADEMARK OFFICE

CERTIFICATE OF CORRECTION

PATENT NO. : 5,607,000

DATED : March 4, 1997

INVENTOR(S) : Jerry D. Cripe
Michael P. Menchio
Kevin Rak

It is certified that error appears in the above-indentified patent and that said Letters Patent is hereby corrected as shown below:

Claim 6, column 6, line 14
Insert --to the-- before "first".

Signed and Sealed this

Twenty-fourth Day of June, 1997

Bruce Lehman

*Attest:*

BRUCE LEHMAN

*Attesting Officer*

*Commissioner of Patents and Trademarks*